US007394359B2

(12) United States Patent
Eskildsen

(10) Patent No.: US 7,394,359 B2
(45) Date of Patent: Jul. 1, 2008

(54) SECURITY SYSTEM WITH WIRELESS RF PORTABLE MONITOR

(75) Inventor: Kenneth G. Eskildsen, Great Neck, NY (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/744,754

(22) Filed: Dec. 23, 2003

(65) Prior Publication Data

US 2005/0134454 A1 Jun. 23, 2005

(51) Int. Cl.
*G08B 1/08* (2006.01)
*G04Q 7/00* (2006.01)

(52) U.S. Cl. ..... 340/539.1; 340/539.11; 340/539.14

(58) Field of Classification Search ..... 340/539.1, 340/539.11, 539.14
See application file for complete search history.

(56) References Cited

U.S. PATENT DOCUMENTS 5,689,235 A * 11/1997 Sugimoto et al. ..... 340/541
6,060,994 A * 5/2000 Chen ..... 340/521
6,219,540 B1 * 4/2001 Besharat et al. ..... 455/421
6,542,076 B1 * 4/2003 Joao ..... 307/10.2
6,542,077 B2 * 4/2003 Joao ..... 340/426.16
6,549,130 B1 * 4/2003 Joao ..... 307/10.2
6,587,046 B2 * 7/2003 Joao ..... 340/539.14
6,658,091 B1 * 12/2003 Naidoo et al. ..... 379/37
6,781,509 B1 * 8/2004 Oppedahl et al. ..... 340/286.01
6,792,323 B2 * 9/2004 Krzyzanowski et al. ..... 700/90
2002/0067256 A1 * 6/2002 Kail, IV ..... 340/539
2004/0217847 A1 * 11/2004 Fries et al. ..... 340/7.21
2005/0086366 A1 * 4/2005 Luebke et al. ..... 709/238

FOREIGN PATENT DOCUMENTS

JP 04284784 A * 10/1992

* cited by examiner

*Primary Examiner*—George A Bugg
*Assistant Examiner*—Travis R Hunnings
(74) *Attorney, Agent, or Firm*—Scully, Scott, Murphy & Presser, P.C.

(57) ABSTRACT

A security system is disclosed for a protected space such as a residential or commercial premises that transmits a wireless RF video transmission to a wireless RF portable video monitor/display accessible to a homeowner/person prior to the person entering the security system protected premises. The portable video monitor can be mounted on the dashboard of the person's automobile to display the status of the security system and possibly video images provided by security system video cameras when the automobile is within range of the RF transmission, which can be a short range RF transmission, typically within visible range of the premises. This enables the person to review the status of the security system and video images before entering the premises to determine if it is safe to enter.

30 Claims, 1 Drawing Sheet

SECURITY SYSTEM WITH WIRELESS RF PORTABLE MONITOR

BACKGROUND OF THE INVENTION

1. Field of the Invention

The present invention relates generally to a security system and method having a wireless RF portable monitor, and more particularly pertains to a security system and method having a wireless RF portable monitor/display which may be carried as a portable unit or mounted or detachably mounted as a portable display, such as mounted on the dashboard of an automobile.

2. Discussion of the Prior Art

Security system installations frequently place video cameras and security monitoring sensors, such as intrusion sensors and motion detectors, throughout and around the perimeter of a protected space to detect the presence of an intruder. The status of the security system and the video camera recordings are frequently available for review within the protected space, such as on a security console and video display. Typically a central security station at a distant location can also review the status of the complete security system and camera recordings by communications over a telephone line and/or cable network and/or internet connections.

However in many present residential home and commercial property security systems, a person or homeowner entering the premises cannot review the status of the complete security system or view the video camera recordings prior to entering the premises because the status and video recordings are only available for viewing inside the premises. This restriction may allow the person entering the premises to inadvertently walk into a burglary in progress in the protected premises without the security system giving any forewarning to the person of the burglary.

SUMMARY OF THE INVENTION

The present invention provides a security system and method having a wireless RF portable monitor and display. The present invention provides a security system and method for a protected space such as a residential or commercial premises with a wireless RF portable monitor/display. The security system typically incorporates a security control panel, security sensors such as intrusion sensors or motion sensors, video cameras, a wireless RF video transmitter or transceiver within the security protected premises, and at least one portable video monitor/display comprising a wireless RF video receiver or transceiver and display within a portable housing. The portable monitor can be hand held and carried or can be carried in an automobile, such as mounted on the dashboard of the automobile.

BRIEF DESCRIPTION OF THE DRAWINGS

The foregoing objects and advantages of the present invention for a security system and method with a wireless RF portable monitor may be more readily understood by one skilled in the art with reference being had to the following detailed description of several embodiments thereof, taken in conjunction with the accompanying drawings in which.

DETAILED DESCRIPTION OF THE INVENTION

Figure 1:
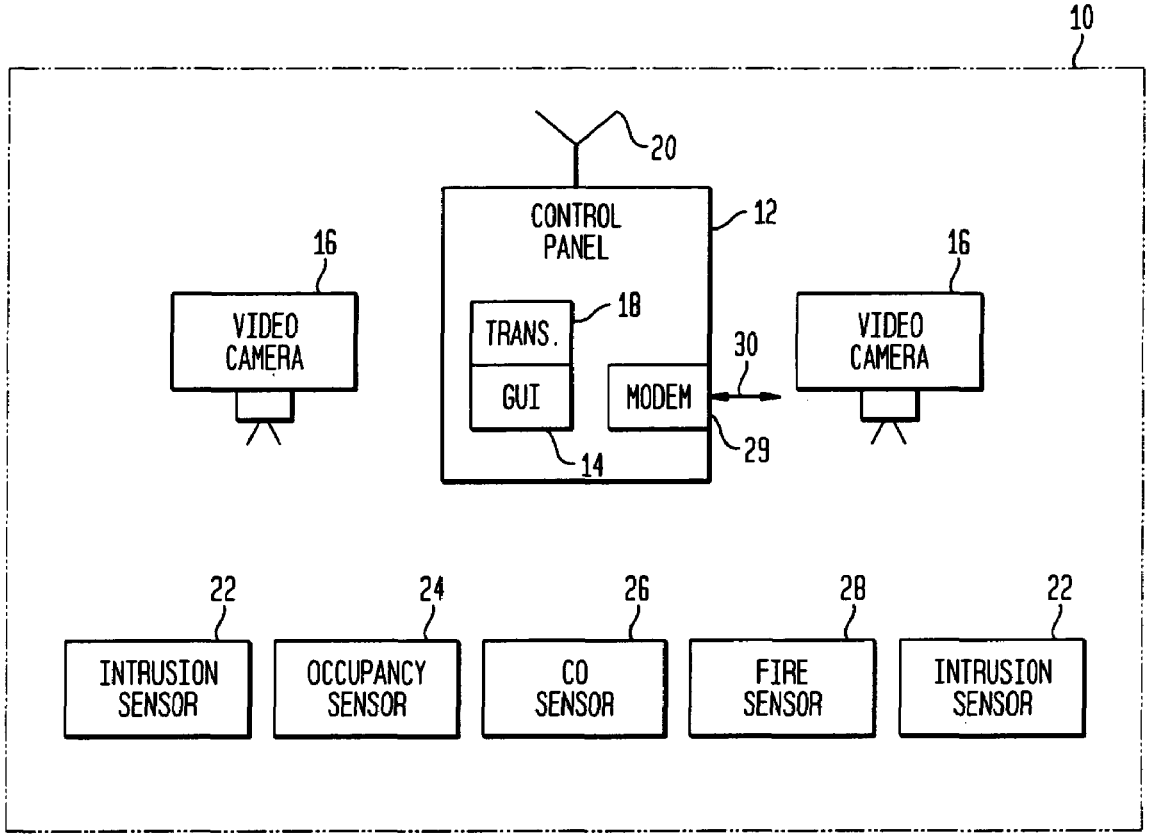
FIG. 1 illustrates a security system for a residential or commercial premises that typically comprises a security system control panel provided at a central accessible location, such as just inside the front entrance to the residential premises, security sensors and security video cameras.

FIG. 1 illustrates a security system for a protected space such as a residential or commercial premises 10 that typically comprises a security system control panel 12 provided at a central accessible location, such as just inside the front entrance to the premises protected by the security alarm system. The control panel provides a person or homeowner with a display 14 of information on the complete status of the security system, such as a display of pertinent parameters and conditions of the security system, and also possibly provides a display of video images provided by the security system video cameras 16.

The control panel also enables a person to control operation of the security system, such as arming or disarming of the security system by entry of a proper security code and of specific commands. The control panel might include a GUI display (graphical user interface) 14 to enable a user to view the status of the security alarm system and also to enter data into and access and control the security system.

The security system control panel also includes an RF transmitter or transceiver 18 and antenna 20, short range RF transmissions of up to one mile in one embodiment, to transmit and possibly receive (with an RF transceiver) RF transmitted data, and the security system might be a wireless system with many of the communications between sensors and the control panel being by RF communication messages.

A typical residential or commercial security system also includes a plurality of intrusion security sensors 22 mounted at doors and windows to detect any intrusions thereat and motion/occupancy sensors 24 mounted at strategic locations in the premises to detect the presence of a person thereat which are connected by security system wiring to the security system control panel. A typical security system might also include one or more CO sensors 26 and smoke or fire sensors 28 mounted at strategic locations in the premises to detect any of those conditions in the premises, with those sensors also being connected by security system wiring to the security system control panel. The security system control panel monitors signals from the security system sensors and video cameras to determine the status of the security system.

A typical residential or commercial security system might also include a modem 29 and a telephone line or cable connection to allow bi-directional data communications over telephone lines and/or a cable system and/or the internet, as indicated schematically at 30.

The RF transmitter or transceiver 18 allows the security system to transmit and possibly receive RF transmitted data to enable the homeowner to review the status of the security system, and also possibly to review video images provided by the security system video cameras, to determine if it is safe to enter the security system protected premises before the person actually enters.

Figure 2:
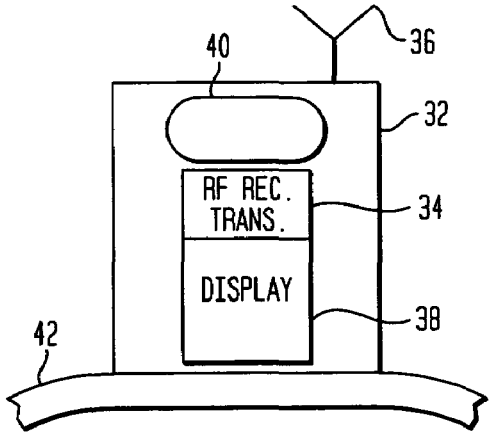
FIG. 2 illustrates a wireless RF portable video monitor/display pursuant to the present invention that includes an RF receiver or transceiver to receive and possibly transmit RF data and a video display.

The present invention provides a security system and method for a protected space such as a residential or commercial premises that transmits a wireless RF transmission to a wireless RF portable video monitor/display 32, as illustrated in FIG. 2, that includes an RF receiver or transceiver 34 and an RF antenna 36 to receive and possibly transmit (by the RF transceiver) RF data and a video display 38. The portable video monitor/display 32 is accessible to a homeowner/person, and may be carried, with or without a depression or handle 40 to facilitate handling, as a portable unit or mounted or detachably mounted as a display, such as in that person's automobile. The portable video monitor/display enables the person to review the status of the security system, and possibly video images taken by security system video cameras, before entering the premises to determine if it is safe to enter prior to the person entering the security system protected premises.

For example, a portable video monitor can be mounted or detachably mounted on the dashboard 42 of the automobile to display the status of the security system, and also possibly video images provided by the security system video cameras, when the automobile is within range of the RF transmission, typically within one mile or visible range of the premises for a short range RF transmission. This enables the person or homeowner to review the status of the security system, and also possibly review video images taken by the security system video cameras, before entering the premises to determine if it is safe to enter.

In addition, the portable video monitor/display can be used when entering or exiting the security system protected property to view areas with obscured visibility. For example, a security video camera may be positioned to provide a display of the driveway and the adjacent street and sidewalk. Before exiting a driveway the homeowner/person might view the display of the driveway and the adjacent street and sidewalk on the video monitor/display, thereby alerting the driver to possible problems with pedestrians or oncoming traffic.

The security control panel can transmit the status of the security system and/or video images via the RF transmitter or transceiver by an encrypted transmission such that only an authorized receiver or receivers can decode the information. Furthermore, the transmission can be encrypted with a personal ID such that only a specific user(s) can receive the specific transmission. The receiver or transceiver in the portable video monitor/display, which can be mounted in an automobile, receives the encrypted transmission when it is within the RF range of the transmitter, typically several hundred feet for a short range RF transmission. Several different persons, with the same or a different personal ID, can have a portable video monitor/display, and each person could carry the portable video monitor/display on their person or in their automobile or mount the portable video monitor/display in the automobile such as on the dashboard.

In one embodiment, the receiver within the portable video monitor/display is always on, and if the encryption codes of the control panel and the portable video monitor/display match, the status of the security system, and possibly video images provided by the security video cameras, is automatically displayed on the remote monitor video display without intervention by the user. The receiver could also operate in a sniffer mode in which the receiver is dormant until it receives a signal to activate the receiver to a fully operative mode.

One basic embodiment of the present invention could provide the control panel of the security system with only a transmitter, as opposed to a transceiver which also includes a receiver, in which case the transmitter would be a constantly on design transmitting data continually, and the portable video monitor/display need only be equipped with a receiver, as opposed to a transceiver which also includes a transmitter.

A more comprehensive and preferred embodiment of the present invention provides the control panel of the security system with a transceiver, in which case the transmitter could be a constantly on design transmitting data continually or could be operated in response to receiving a transmitted signal from the portable video monitor which is also equipped with a transceiver. Moreover, this type of security system could be more comprehensive, and the portable video monitor/display might be utilized to transmit commands to the security panel, for example to transmit data on the status of the security system, or to transmit an arm command or a disarm command to respectively arm or disarm the security system, or to turn on or off selected lights, or to open or close a garage door. The commands might also be unrelated to the security system, for example to request a transmission by the security system control panel of other data and messages, for example email, and the control panel would respond to the request with a transmission of the requested data.

One basic embodiment of the wireless RF portable video monitor/display might merely display a video screen image providing the status of the security system. A more comprehensive and preferred embodiment of the wireless RF portable video monitor/display would also display video images/frames provided by the security system video cameras.

While several embodiments and variations of the present invention for a security system with a wireless RF portable monitor are described in detail herein, it should be apparent that the disclosure and teachings of the present invention will suggest many alternative designs to those skilled in the art.

What is claimed is:

1. A security system for a protected space, comprising:

the security system including a control panel, security sensors for detecting security/alarm events in the protected space, and a wireless RF transmitter for transmitting data on the status of the security system;

a portable video monitor including a wireless RF receiver and a display, for enabling the portable monitor to receive and display data on the status of the security system, in a portable housing, and the portable video monitor being mounted in an automobile; and wherein the portable video monitor remains constantly on and becomes dormant when beyond a transmitting range of the wireless RF transmitter and becomes automatically active when within the transmitting range of the wireless RF transmitter.

2. The security system of claim 1, wherein the security system includes a short range wireless RF video transmitter for short range RF transmissions up to one mile.

3. The security system of claim 1, wherein the security system includes at least one security video camera for taking video frames, and the portable monitor includes a video display for displaying the video frames taken by the at least one security video camera.

4. The security system of claim 3, wherein a security system video camera is positioned to view areas with obscured visibility, and the portable monitor and display are used to view the areas with obscured visibility.

5. The security system of claim 1, wherein the portable video monitor is mounted on a dashboard of the automobile to enable the portable video monitor to display the status of the security system when the automobile is within range of the RF transmitter.

6. The security system of claim 1, wherein the portable video monitor is hand carried by a user to enable the portable video monitor to display the status of the security system when the user is within range of the RF transmitter.

7. The security system of claim 1, wherein the security system includes a modem and a telephone line or cable connection to allow bi-directional data communications over the telephone line or cable connection.

8. The security system of claim 1, wherein the security system control panel transmits data on the status of the security system by an encrypted RF transmission such that only an authorized receiver or receivers can decode the information.

9. The security system of claim 8, wherein when encryption codes of the control panel and the portable monitor match, the status of the security system is automatically displayed on the display of the portable monitor without intervention by a user when the portable monitor is within range of the RF transmitter.

10. The security system of claim 1, wherein the security system control panel transmits data on the status of the security system by an encrypted RF transmission that is encrypted with a personal ID such that only a specific user(s) having the personal ID can access the encrypted RF transmission.

11. The security system of claim 1, wherein the status of the security system is automatically displayed on the portable monitor without intervention by a user when the portable monitor is within range of the RF transmitter.

12. The security system of claim 1, wherein the control panel of the security system includes an RF transceiver which includes the RF transmitter and also an RF receiver, and the portable monitor includes a transceiver which includes the RF receiver and also an RF transmitter, such that the portable monitor and the security system control panel can bi-directionally transmit data or commands.

13. The security system of claim 12, wherein the portable monitor transmits a request for a transmission of data by the security system control panel that is unrelated to the security system, and the control panel responds to the request with a transmission of the requested data.

14. A method of operating a security system for a protected space, the security system including a control panel, security sensors for detecting security/alarm events in the protected space, and a wireless RF transmitter, comprising:

transmitting by the wireless RF transmitter data on the status of the security system;

receiving and displaying data on the status of the security on a portable video monitor including a wireless RF receiver and a display, in a portable housing, and the portable monitor being mounted in an automobile; and wherein the portable video monitor remains constantly on and becomes dormant when beyond a transmitting range of the wireless RF transmitter and becomes automatically active when within the transmitting range of the wireless RF transmitter.

15. The method of claim 14, wherein the step of transmitting includes transmitting short range wireless RF video transmissions having a range up to one mile.

16. The method of claim 14, wherein the security system includes at least one security video camera for taking video frames, and including displaying on the portable monitor the video frames taken by the at least one security video camera.

17. The method of claim 16, including positioning a security system video camera to view areas with obscured visibility, and displaying on the portable monitor and display the areas with obscured visibility.

18. The method of claim 14, including mounting the portable monitor on a dashboard of the automobile to enable the portable monitor to display the status of the security system when the automobile is within range of the RF transmitter.

19. The method of claim 14, including a user hand carrying the portable monitor to enable the portable monitor to display the status of the security system when the user is within range of the RF transmitter.

20. The method of claim 14, wherein the security system includes a modem and a telephone line or cable connection, and including bi-directionally communicating data over the telephone line or cable connection.

21. The method of claim 14, including transmitting data on the status of the security system by an encrypted RF transmission that is encrypted with a personal ID, and accessing the encrypted RF transmission only by a specific user(s) having the personal ID.

22. The method of claim 14, including transmitting data on the status of the security system by an encrypted RF transmission such that only an authorized receiver or receivers can decode the information.

23. The method of claim 14, wherein if encryption codes of the control panel and the portable monitor match, automatically displaying the status of the security system on the display of the portable monitor without intervention by a user when the portable monitor is within range of the RF transmitter.

24. The method of claim 14, including automatically displaying the status of the security system on the display of the portable monitor without intervention by a user when the portable monitor is within range of the RF transmitter.

25. The method of claim 14, wherein the control panel of the security system includes an RF transceiver which includes the RF transmitter and also an RF receiver, and the portable monitor includes a transceiver which includes the RF receiver and also an RF transmitter, and the portable monitor and the security system control panel bi-directionally communicating data or commands.

26. The method of claim 25, including the portable monitor requesting a transmission of data by the security system control panel that is unrelated to the security system, and the control panel responding to the request with a transmission of the requested data.

27. A security system for a protected space, comprising:

the security system including a control panel, security sensors for detecting security/alarm events in the protected space, and a wireless RF transmitter;

means for transmitting by the wireless RF transmitter data on the status of the security system;

means for receiving and displaying data on the status of the security on a portable monitor including a wireless RF receiver and a display, in a portable housing, and the portable monitor being mounted in an automobile;

wherein the portable video monitor remains constantly on and becomes dormant when beyond a transmitting range of the wireless RF transmitter and becomes automatically active when within the transmitting range of the wireless RF transmitter.

28. The security system of claim 27, wherein the security system includes at least one security video camera means for taking video frames, and the portable monitor includes means for displaying the video frames taken by the at least one security video camera.

29. The security system of claim 27, including means for mounting the portable monitor on a dashboard of the automobile, such that the portable monitor can display the status of the security system when the automobile is within range of the RF transmitter.

30. The security system of claim 27, including means to enable a user to hand carry the portable monitor, such that the portable monitor can display the status of the security system when the user is within range of the RF transmitter.

* * * * *